United States Patent [19]

Kawamoto et al.

[11] Patent Number: 4,862,843

[45] Date of Patent: Sep. 5, 1989

[54] VALVE TIMING CONTROL DEVICE FOR USE IN INTERNAL COMBUSTION ENGINE

[75] Inventors: Michio Kawamoto, Saitama; Yoshihiro Fujiyoshi, Kanagawa; Takatoshi Aoki, Tokyo; Yasuhiro Urata, Saitama, all of Japan

[73] Assignee: Honda Giken Kogyo Kabushiki Kaisha, Tokyo, Japan

[21] Appl. No.: 206,847

[22] Filed: Jun. 15, 1988

[30] Foreign Application Priority Data

Jun. 23, 1987 [JP] Japan ..... 62-155927
Nov. 19, 1987 [JP] Japan ..... 62-292614
Nov. 19, 1987 [JP] Japan ..... 62-292615

[51] Int. Cl.[4] ..... F01L 9/04

[52] U.S. Cl. ..... 123/90.11; 123/90.13; 123/90.17

[58] Field of Search ..... 123/90.11, 90.12, 90.13, 123/90.15, 90.17, 90.27, 90.31

[56] References Cited

U.S. PATENT DOCUMENTS 4,305,352 12/1981 Oshima et al. .
4,357,917 11/1982 Aoyama .
4,494,495 1/1985 Nakamura et al. .
4,494,496 1/1985 Nakamura et al. .
4,498,431 2/1985 Nakamura et al. .
4,517,934 5/1985 Papez .
4,561,390 12/1985 Nakamura et al. .
4,583,501 4/1986 Williams .
4,787,345 11/1988 Thoma ..... 123/90.17

FOREIGN PATENT DOCUMENTS 3444277 2/1986 Fed. Rep. of Germany ... 123/90.17
2120320 11/1983 United Kingdom ..... 123/90.17

*Primary Examiner*—Charles J. Myhre
*Assistant Examiner*—Weilun Lo
*Attorney, Agent, or Firm*—Lyon & Lyon

[57] ABSTRACT

A valve timing control device includes a rotatable shaft, a housing including a timing wheel axially immovable but angularly movable with respect to the timing wheel, a piston disposed coaxially with the rotatable shaft and the timing wheel, a hydraulic chamber for applying a hydraulic pressure to move the piston axially, a servo-valve disposed between the hydraulic pressure chamber and hydraulic pressure supply and release passages and comprising a sleeve and a spool, an actuator for axially moving the spool, and a phase adjusting mechanism operatively coupling the piston, the housing, and the rotatable shaft for varying angular relationship between the timing wheel and the rotatable shaft in response to axial movement of the piston. The actuator may be a hydraulic actuator or an electric actuator. The phase adjusting mechanism may comprise roller pins mounted on the piston and rollingly fitted in a guide groove defined in the rotatable shaft and a guide slot defined in the housing, or meshing helical teeth on the piston, the housing, and the rotatable shaft.

12 Claims, 4 Drawing Sheets

FIG. 2a.
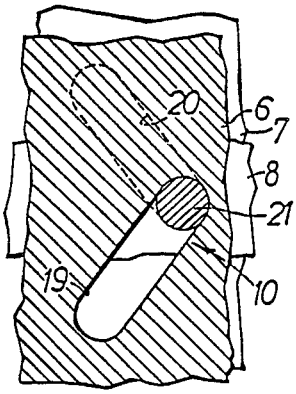
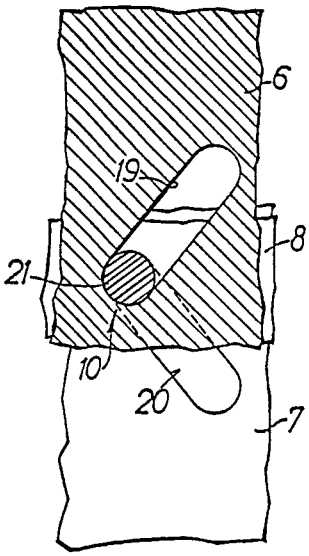
FIG. 2b.

VALVE TIMING CONTROL DEVICE FOR USE IN INTERNAL COMBUSTION ENGINE

BACKGROUND OF THE INVENTION

The present invention relates to a valve timing control device for use in an internal combustion engine for continuously controlling or varying the timing at which an intake or exhaust valve is opened and closed.

One known valve timing control device for use in internal combustion engines is disclosed in Japanese Laid-Open Patent Publication No. 61-268810, for example.

The disclosed valve timing control device includes a phase adjusting mechanism for varying the relative phase or angular relationship between a timing pulley and a camshaft to control or vary the timing at which an intake or exhaust valve is opened and closed. The phase adjusting mechanism has a piston movable between two positions. The piston reaches one of the positions when hydraulic pressure is supplied to a hydraulic pressure chamber and reaches the other position when hydraulic pressure is released from the hydraulic pressure chamber. The timing at which the intake or exhaust valve is opened and closed is only controlled such that it is advanced or retarded a certain fixed amount.

Another problem with the earlier valve timing control device is that the timing pulley is mounted on a housing having opposite ends supported by respective rotatable shafts. Therefore, the piston has a small pressure-bearing area and is operable at a limited speed.

SUMMARY OF THE INVENTION

In view of the aforesaid drawbacks of the conventional valve timing control device, it is an object of the present invention to provide a valve timing control device for use in an internal combustion engine, which is capable of continuously controlling or varying the timing at which an intake or exhaust valve is opened and closed.

Another object of the present invention is to provide a valve timing control device for use in an internal combustion engine, which includes a piston having a large pressure-bearing area for higher speed of operation.

According to the present invention, there is provided a valve timing control device for use in an internal combustion engine having a camshaft and a crankshaft, comprising a rotatable shaft adapted to be coupled coaxially to the camshaft, a housing including a timing wheel disposed coaxially with the rotatable shaft and rotatable by the crankshaft, the timing wheel being axially immovable but angularly movable with respect to the timing wheel, a piston disposed coaxially with the rotatable shaft and the timing wheel, a hydraulic chamber for exerting a hydraulic pressure to move the piston axially in one direction, a return spring for normally urging the piston to move in a direction opposite to the one direction against the hydraulic pressure, a servovalve disposed between the hydraulic pressure chamber and hydraulic pressure supply and release passages, the servovalve comprising a sleeve operatively coupled to the piston and axially movably disposed in the rotatable shaft, a spool relatively movably disposed in the sleeve and axially movable to provide communication between the hydraulic chamber and the hydraulic pressure supply or release passage, and means for cutting off the communication in response to axial movement of the piston and the sleeve following the axial movement of the spool, an actuator for axially moving the spool, and a phase adjusting mechanism operatively coupling the piston, the housing, and the rotatable shaft for varying angular relationship between the timing wheel and the rotatable shaft in response to the axial movement of the piston.

The actuator comprises a hydraulic actuator or an electric actuator.

The phase adjusting mechanism comprises a guide groove defined in the rotatable shaft obliquely to an axis of the rotatable shaft, a first roller pin supported on the piston and rollingly fitted in the guide groove, a guide slot defined in the housing obliquely to the axis of the rotatable shaft, and a second roller pin supported on the piston and rollingly fitted in the guide slot.

Alternatively, the phase adjusting mechanism comprises first helical teeth on an outer peripheral surface of the piston, second helical teeth on an inner peripheral surface of the housing in mesh with the first helical teeth, third helical teeth on an inner peripheral surface of the piston, and fourth helical teeth on an outer peripheral surface of the rotatable shaft in mesh with the third helical teeth.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIGS. 2(*a*) and 2(*b*) are cross-sectional views taken along line II—II of FIG. 1, showing different angular positions;

DESCRIPTION OF THE PREFERRED EMBODIMENTS

Figure 1:
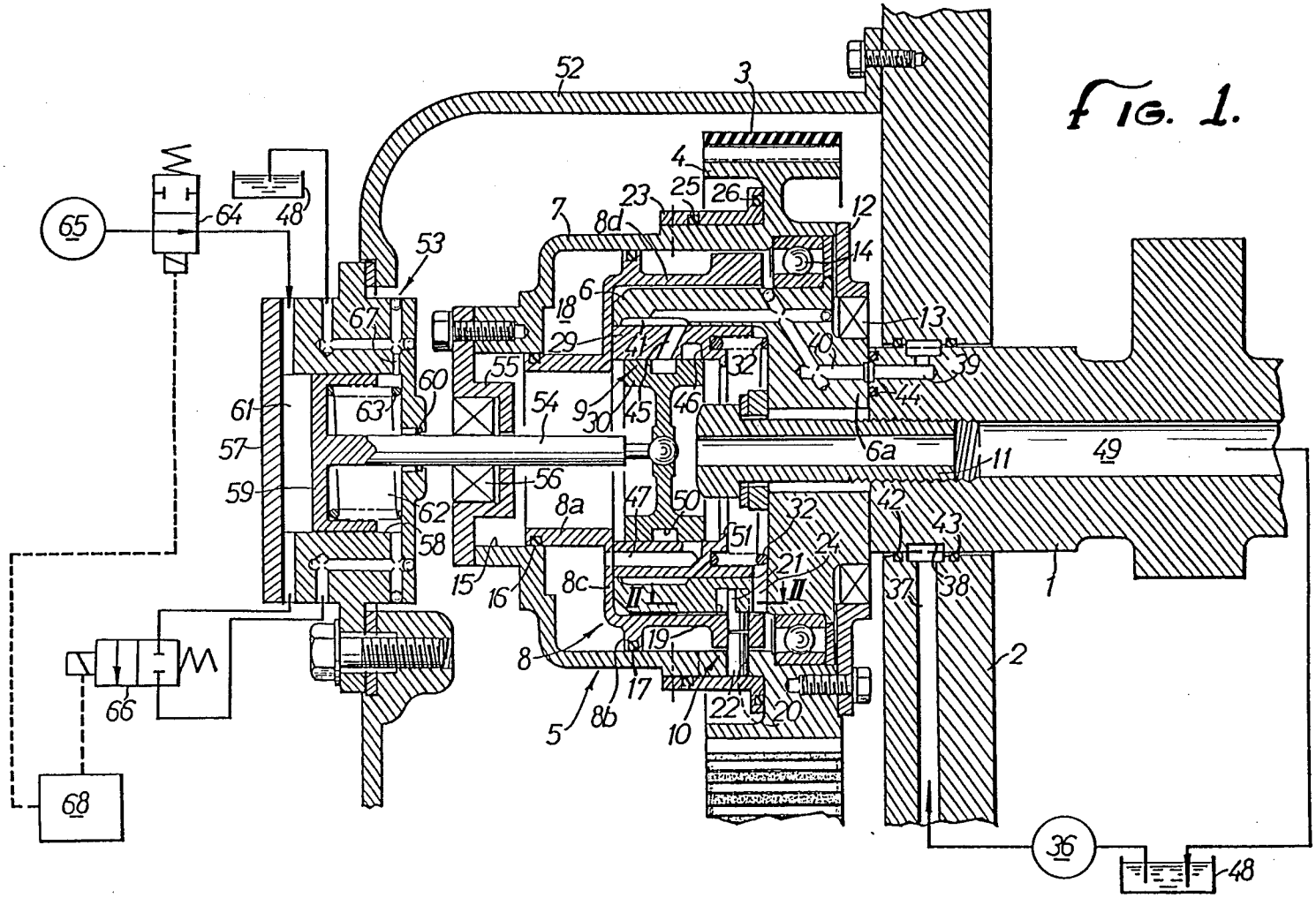
FIG. 1 is a vertical cross-sectional view of a valve timing control device according to an embodiment of the present invention.

Like or corresponding parts are denoted by like or corresponding reference numerals throughout the respective views.

A valve timing control device for use in an internal combustion engine, according to an embodiment of the present invention, is illustrated in FIG. 1.

A camshaft 1 for opening and closing an intake or exhaust valve (not shown) is rotatably supported in an engine body 2. A timing belt 3 is trained around a timing wheel or pulley 4 for transmitting rotative power from a crankshaft (not shown) of the engine. The pulley 4 and the camshaft 1 are operatively coupled to each other by a timing control assembly 5 capable of varying the phase or angular relationship between the pulley 4 and the camshaft 1.

The timing control assembly 5 comprises a rotatable shaft 6 coaxially coupled to the camshaft 1, a housing 7 integral with the pulley 4 and surrounding the rotatable shaft 6 in coaxial relationship, a piston 8 having one axial end disposed in a hydraulic pressure chamber 18 and positioned coaxially with the housing 7 and the rotatable shaft 6, the piston 8 being normally urged in one axial direction by a spring 32, a servovalve 9 for controlling axial movement of the piston 8, and a phase adjusting mechanism 10 for operatively coupling the piston 8, the housing 7, and the rotatable shaft 6 to vary the phase or angular relationship between the pulley 4 and the rotatable shaft 6 according to axial movement of the piston 8.

The rotatable shaft 6 is in the form of a hollow bottomed cylinder with a shaft portion 6*a* on its closed end. The shaft portion 6*a* is fixed coaxially to an end of the camshaft 1 by means of a bolt 11 extending coaxially through the closed end of the shaft 6 threadedly into the camshaft 1. The housing 7 is also in the form of a hollow bottomed cylinder which is open toward the camshaft 1. The pulley 4 is disposed on an outer peripheral surface of the housing 7 closer to the open end thereof, i.e., the camshaft 1. An annular end plate 12 is fixed to the end of the housing 7 closer to the camshaft 1 in covering relation to the outer peripheral edge of the shaft 6. A seal member 13 is interposed between the inner periphery of the end plate 12 and the outer periphery of the shaft portion 6*a* of the shaft 6. Near the pulley 4, there is disposed a bearing 14 between an inner peripheral surface of the housing 7 and an outer peripheral surface of the shaft 6. The bearing 14 between the housing 7 and the shaft 6 has an outer race with one end thereof axially engaging the housing 7 and an inner race with the opposite end thereof axially engaging the shaft 6. Therefore, the housing 7 and the pulley 4 are prevented from axially moving with respect to the shaft 6 and the camshaft 1, but are allowed to rotate about the axis of the shaft 6 and the camshaft 1.

The housing 7 has a through hole 15 defined centrally in the closed end thereof. The piston 8 comprises a cylindrical portion 8*a* slidably held against an inner peripheral surface of the through hole 15, a ring portion 8*b* slidably held against an inner peripheral surface of the housing 7, and a dish-shaped connecting plate portion 8*c* interconnecting the cylindrical portion 8*a* and the ring portion 8*b*. A seal member 16 is fitted over an outer peripheral surface of the cylindrical portion 8*a* in sliding contact with the inner peripheral surface of the through hole 15. Another seal member 17 is fitted over an outer peripheral surface of the ring portion 8*c* in sliding contact with the inner peripheral surface of the housing 7. The housing 7 and the piston 8 define the hydraulic pressure chamber 18 between the seal members 16, 17. When hydraulic pressure is supplied to the hydraulic pressure chamber 18, the piston 8 is axially pressed toward the camshaft 1. The seal members 16, 17 are of the piston ring type having a split or slit in a peripheral portion thereof. The seal members 16, 17 are effective to reduce resistance to sliding movement of the piston 8.

The piston 8 also includes an integral supporting cylindrical portion 8*d* extending axially from the ring portion 8*b* toward the camshaft 1 and disposed between the housing 7 and the shaft 6. The supporting cylindrical portion 8*d*, the housing 7, and the shaft 6 are operatively coupled to each other by the phase adjusting mechanism 10.

As shown in FIGS. 2(*a*) and 2(*b*), the phase adjusting mechanism 10 has a guide groove 19 defined in an outer peripheral surface of the shaft 6, a guide slot 20 defined in the housing 7 radially outwardly of the guide groove 19, a roller pin 21 supported on the supporting cylindrical portion 8*d* and rollingly fitted in the guide groove 19, and a roller pin 22 supported on the supporting cylindrical portion 8*d* coaxially with the roller pin 21 and rollingly fitted in the guide slot 20. The guide groove 19 and the guide slot 20 intersect with each other obliquely to the axis of the shaft 6 and the housing 7. When the rollers 21, 22 are moved with the piston 8 axially of the shaft 6 and the housing 7, the roller pins 21, 22 rollingly move in the guide groove 19 and the guide slot 20 to turn the shaft 6 and the housing 7 in mutually opposite directions for thereby varying the phase or angular relationship between the shaft 6 and hence the camshaft 1, and the housing 7 and hence the pulley 4. More specifically, when the piston 8 is moved into a position closest to the camshaft 1, the shaft 6 and the housing 7 are relatively angularly positioned as shown in FIG. 2(*a*), and when the piston 8 is moved into a position remotest from the camshaft 1, the shaft 6 and the housing 7 are relatively angularly positioned as shown in FIG. 2(*b*). The phase adjusting mechanism 10 includes a plurality of, three, for example, such pin-and-groove/slot combinations at equal angularly spaced locations in the circumferential direction of the piston 8 radially inwardly of the pulley 4.

As illustrated in FIG. 1, a cylindrical cover 23 is fitted over the housing 7 for preventing the roller pins 22 from being removed from the guide slots 20, the cover 23 being fixed to the housing 7. Seal members 25, 26 are disposed between the housing 7 and the cover 23 one on each side of the guide slots 20. The shaft 6 has a radial breathing hole 24 through which the interior space of the shaft 6 communicates with the space between the shaft 6 and the housing 7.

The servovalve 9 comprises a cylindrical sleeve 29 slidably fitted in the shaft 6 and a cylindrical spool 30 slidably fitted in the sleeve 29. A spring 32 is disposed under compression between the sleeve 29 and the closed end of the shaft 6 for normally urging the sleeve 29 in an axial direction to hold one end of the sleeve 29 against the connecting plate portion 8*c* of the piston 8. Therefore, the piston 8 is also urged by the spring 32 in a direction to contract the hydraulic pressure chamber 18 against the hydraulic pressure therein.

The engine body 2 has a first hydraulic pressure supply passage 37 defined therein in communication with a hydraulic pressure pump 36. The camshaft 1 has an annular groove 38 defined in an outer peripheral surface thereof and communicating with the first hydraulic pressure supply passage 37, and also has a second hydraulic pressure supply passage 39 defined therein and communicating with the annular groove 38. The shaft 6 has a third hydraulic pressure supply passage 40 defined therein and held in communication with the second hydraulic pressure supply passage 39 at all times. The shaft 6 also has an annular groove 41 defined in an inner peripheral surface thereof and communicating with the third hydraulic pressure supply passage 40. A pair of annular seal members 42, 43 is interposed between the camshaft 1 and the engine body 2 in sandwiching relation to the annular groove 38. Another pair of annular seal members 44 is interposed between the camshaft 1 and the shaft 6 for keeping the second and third hydraulic pressure supply passages 39, 40 in communication with each other.

The sleeve 29 has an oil hole 45 defined radially therethrough which is held in communication with the annular groove 41 at all times irrespective of the axial position of the sleeve 29 with respect to the shaft 6. The sleeve 29 also has an annular groove 46 defined in an inner peripheral surface thereof at a position adjacent to the open end of the oil hole 45 on one side thereof closer to the camshaft 1. The sleeve 29 and the connecting plate portion 8c held against the sleeve 29 have an oil passage 47 defined therein through which the annular groove 46 communicates with the hydraulic pressure chamber 18. The bolt 11 and the camshaft 1 have a pressure release passage 49 defined axially therethrough and held in communication with an oil tank 48 coupled to the hydraulic pressure pump 36.

An annular groove 50 is defined in an outer peripheral surface of the spool 30 and has an axial width selected such that it can provide fluid communication between the oil hole 45 and the annular groove 46. The spool 30 is axially movable between three positions, i.e., a cutoff position in which only the oil hole 45 communicates with the annular groove 50, a supply position in which the oil hole 45 and the annular groove 46 communicate with each other through the annular groove 50, and a release position in which the annular groove 46 communicates with the pressure release passage 49. The sleeve 29 has a stopper 51 extending radially inwardly from an axial end thereof closer to the camshaft 1 for abutting against the spool 30 to limit relative axial movement of the sleeve 29 and the spool 30.

A support member 52 is fixed to the engine body 2 in covering relation to the timing control assembly 5. To the support member 52, there is secured a fluid actuator 53 coaxial with the timing control assembly 5 and having a driver shaft 54 coupled to the spool 30. A cap 55 covering the through hole 15 is fixed t the closed end of the housing 7. The driver shaft 54 extends axially movably through the center of the cap 55 with a seal member 56 interposed between the driver shaft 54 and the cap 55.

The fluid actuator 53 has a cylindrical casing 57 having closed opposite ends and fixed to the support member 52 coaxially with the camshaft 1. The casing 57 has a cylinder hole 58 defined therein and having closed opposite ends. A driver piston 59 is slidably fitted in the cylinder hole 58 and integrally joined to the driver shaft 54. Thus, the driver shaft 54 coupled to the piston 59 extends movably through the casing 57 and is coupled to the spool 30. A seal member 60 is interposed between the driver shaft 54 and the casing 57.

A first hydraulic pressure chamber 61 is defined between an outer end wall of the casing 57 and the piston 59, whereas a second hydraulic pressure chamber 62 is defined between the piston 59 and an inner end wall of the casing 57. The piston 59 is normally urged to move axially outwardly, i.e., toward the outer end wall of the casing 57 by a spring 63 housed in the second hydraulic pressure chamber 62. The first hydraulic pressure chamber 61 is coupled to a hydraulic pressure source 65 through a solenoid-operated valve 64. The first and second hydraulic pressure chambers 61, 62 are interconnected through a solenoid-operated valve 66. The second hydraulic pressure chamber 62 is connected to the oil tank 48 through a restriction 67 disposed in the casing 57. The solenoid-operated valves 64, 66 are controlled by a control unit 68.

While the solenoid-operated valve 64 is being open, the solenoid-operated valve 66 is controlled to freely adjust the axial position of the piston 59 and hence the driver shaft 54 for thereby determining the axial position of the spool 30.

Operation of the valve timing control device will now be described below. Rotative power transmitted from the crankshaft of the engine through the timing belt 3 is transmitted from the timing belt 3 through the timing control assembly 5 to the camshaft 1, which is rotated to open and close the non-illustrated intake or exhaust valve.

For varying the timing at which the intake or exhaust valve is opened and closed, the fluid actuator 53 is operated to move the shaft 54 to a desired axial position. In FIG. 1, the sleeve 29 and the spool 30 are axially relatively positioned such that only the annular groove 50 communicates with the oil hole 45, and the phase adjusting mechanism 10 is in the position shown in FIG. 2(*a*). When the shaft 54 is moved to the left to displace the spool 30 axially in one direction (to the left in FIG. 1) into the release position, the annular groove 46 communicates with the pressure release passage 49. The hydraulic pressure is now released from the hydraulic pressure chamber 18 to allow the sleeve 29 and the piston to move axially in said one direction under the force of 8 the spring 32. The phase adjusting mechanism 10 turns the shaft 6 and the housing 7 relatively to each other for thereby varying the timing at which the intake or exhaust valve is opened and closed. In response to the movement of the sleeve 29 axially in said one direction, the spool 30 is moved relatively to the sleeve 29 axially in the opposite direction into the cutoff position. Therefore, the amount of movement of the piston 8 is determined dependent on the amount of axial movement of the spool 30, and the amount by which the valve timing is advanced or retarded is determined on the amount of movement of the piston 8. Accordingly, the amount by which the valve timing is varied can continuously be controlled dependent on the amount of movement of the spool 30.

During such operation, the seal members 16, 17 of the piston ring type fitted over the piston 8 are subjected to low resistance to sliding movement thereof, so that the piston 8 can smoothly be operated, and thus the phase adjusting mechanism 10 can smoothly be moved for phase adjustment.

When the servovalve 9 is in the cutoff position, the shaft 54 is moved axially in the opposite direction (to the right in FIG. 1) to move the spool 30 from the cutoff position axially in the opposite direction. The spool 30 then reaches the supply position in which the oil hole 45 and the annular groove 46 communicate with each other through the annular groove 50, whereupon hydraulic pressure from the pump 36 is supplied to the hydraulic chamber 18, moving the piston 8 axially in the opposite direction against the resiliency of the spring 32. In response to the movement of the piston 8 axially in the opposite direction, the shaft 6 and the housing 7 are turned relatively to each other by the phase adjusting mechanism 10 to vary the timing at which the intake or exhaust valve is opened and closed. Since the sleeve 29 also moves with the axial movement of the piston 8, the spool 30 is moved relatively to the sleeve 29 into the cutoff position. Therefore, the amount of movement of the piston 8 is determined dependent on the amount of axial movement of the spool 30, and the timing at which the intake or exhaust valve is opened and closed can continuously be controlled. The breathing hole 24 defined in the shaft 6 quickly relieves the back pressure between the piston 8 and the shaft 6 for thereby allowing the piston 8 to move quickly.

The housing 7 with the pulley 4 thereon is rotatably supported on the shaft 6 by the bearing 14 near the pulley 4, and the phase adjusting mechanism 10 is positioned radially inwardly of the pulley 4. As a result, any load imposed on the distal end of the housing 7 during operation is reduced, making it unnecessary to support the closed end, i.e., the distal end, of the housing 7 with the shaft 6. Therefore, the housing 7 can only be supported in a cantilevered fashion by the shaft 6. Inasmuch as the shaft 6 does not include a portion which would otherwise extend through the connecting plate portion 8*c* and support the distal end of the housing 7, the pressure-bearing area of the piston 8 facing into the hydraulic pressure chamber 18 is relatively large, with the result that the piston 8 and hence the phase adjusting mechanism 10 can operate quickly.

The fluid actuator 53 is shown as being operable under hydraulic pressure, but may be of the type which is operable under pneumatic pressure.

The shaft 6 and the piston 8 or the piston 8 and the housing 7 may be coupled to each other by a structure which prevents their relative angular movement, and the piston 8 and the housing 7 or the shaft 6 and the piston 8 may be coupled to each other by a structure which allows their relative angular movement in response to axial movement of the piston 8.

The roller pins 21, 22 may be replaced with a single roller pin which is supported on the piston 8 and has its opposite ends rollingly fitted in the guide groove 19 and the guide slot 20.

Figure 3:
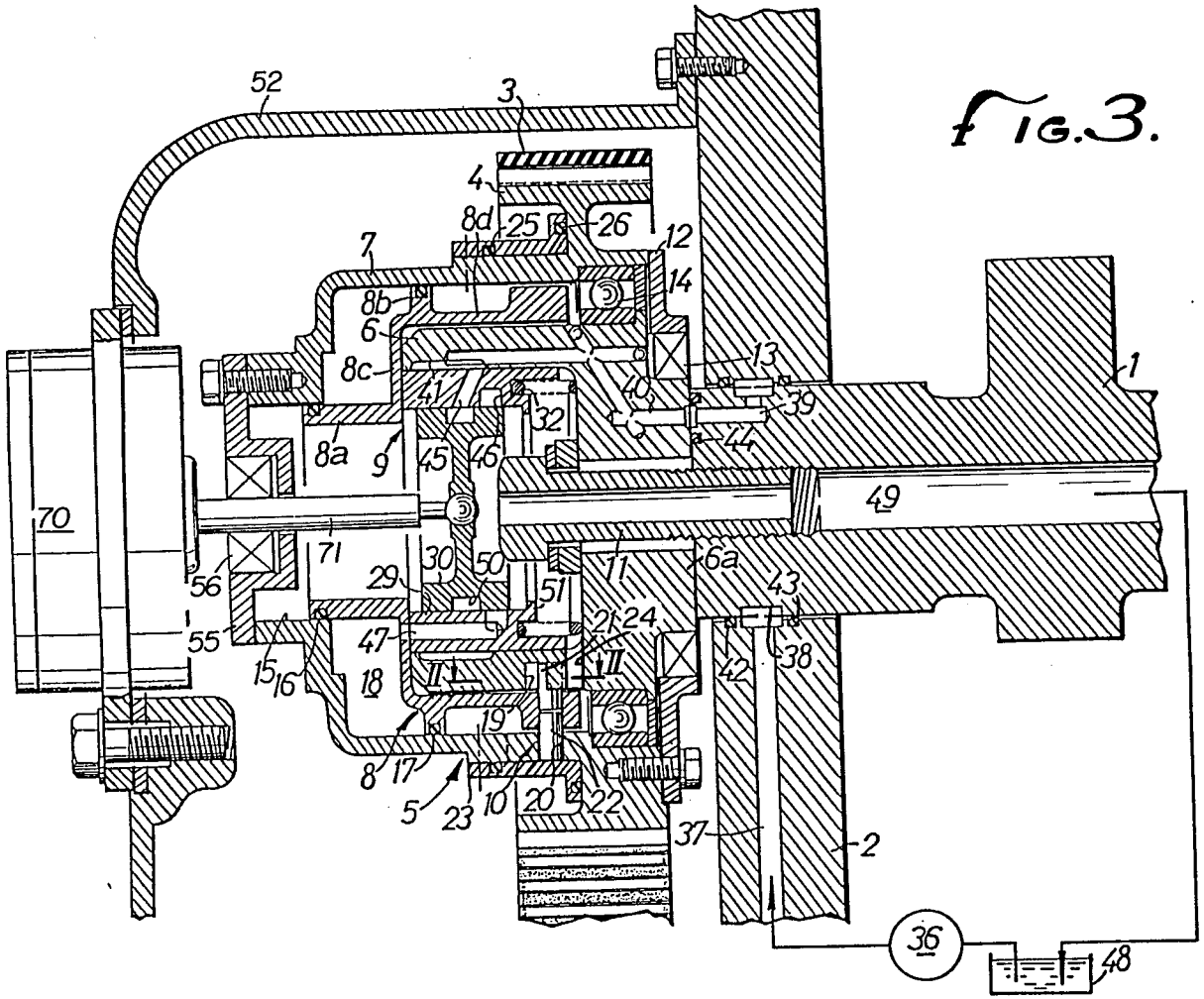
FIG. 3 is a vertical cross-sectional view of a valve timing control device according to another embodiment of the present invention.

FIG. 3 shows a valve timing control device according to another embodiment of the present invention. The valve timing control device shown in FIG. 3 differs from that illustrated in FIG. 1 in that the spool 30 is operated by an electric actuator 70 through a driver shaft 71 thereof, the electric actuator 70 being fastened to the support member 52.

The electric actuator 70 serves to move the shaft 71 and hence the spool 30 into a desired axial position, i.e., one of the cutoff, supply, and release positions referred to above, in response to an electric signal applied thereto. The electric actuator 70 may comprise a DC or AC servomotor, a stepping motor, a linear motor, a motor-operated cylinder, a linear solenoid, a rotary solenoid, a piezoelectric motor, a laminated piezoelectric actuator, or the like.

Figure 4:
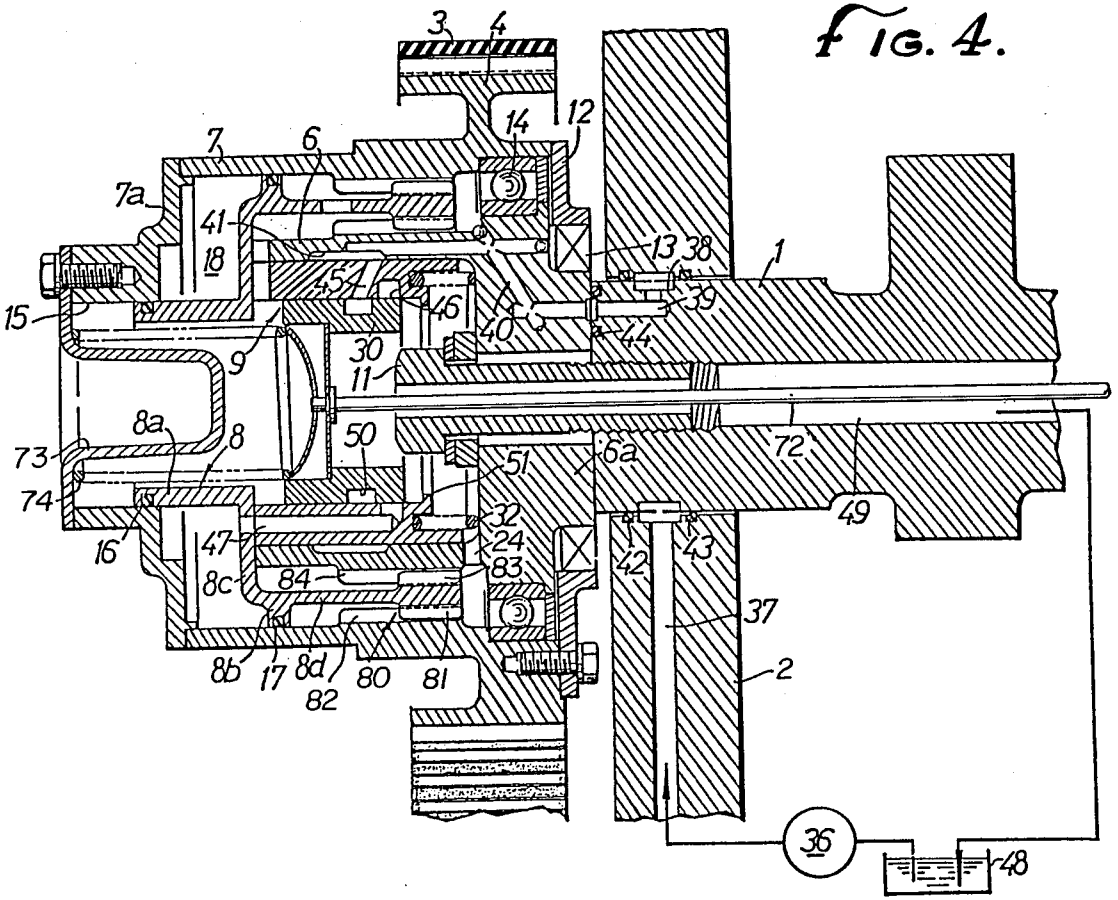
FIG. 4 is a vertical cross-sectional view of a valve timing control device according to still another embodiment of the present invention.

FIG. 4 illustrates a valve timing control device according to still another embodiment of the present invention. Those parts of the valve timing control device of FIG. 4 which are identical to those of the valve timing control device shown in FIG. 1 are denoted by identical reference numerals, and will not be described in detail.

The valve timing control device illustrated in FIG. 4 has a closure plate 7*a* fixed to the end of the housing 7 remote from the camshaft 1, the closure plate 7*a* having a through hole 15. A driver shaft or rod 72 extends axially movably through the pressure release passage 49 and has an end coupled to a spool 30'. A cap 73 is fixed to the closure plate 7*a* in covering relation to the through hole 1. The spool 30' is normally urged to move toward the camshaft 1 by a spring 74 disposed between the cap 73 and the spool 30.

The valve timing control device also includes a phase adjusting mechanism 80 which comprises helical splines or teeth 81 on an outer peripheral surface of the supporting portion 8*d* of the piston 8, helical splines or teeth 82 on an inner peripheral surface of the housing 7 and held in mesh with the helical splines 81, helical splines or teeth 83 on an inner peripheral surface of the supporting portion 8*d* of the piston 8, and helical splines or teeth 84 on an outer peripheral surface of the shaft 6 and held in mesh with the helical splines 83. The phase adjusting mechanism 80 thus constructed can vary the phase or angular relationship between the housing 7 and the shaft 6 in response to axial movement of the piston 8.

The driver shaft 72 may be axially moved by any suitable device such for example as a hydraulic actuator, a pneumatic actuator, an electric actuator, a mechanical actuator, or the like.

Although certain preferred embodiments have been shown and described, it should be understood that many changes and modifications may be made therein without departing from the scope of the appended claims.

What is claimed is:

1. A valve timing control device for use in an internal combustion engine having a camshaft and a crankshaft, comprising:

a rotatably shaft adapted to be coupled coaxially to the camshaft;

a housing including a timing wheel disposed coaxially with said rotatable shaft and rotatable by the crankshaft, said timing wheel being axially immovable but angularly movable with respect to said rotatable shaft;

a piston disposed coaxially with said rotatable shaft and said timing wheel;

a hydraulic chamber for exerting a hydraulic pressure to move said piston axially in one direction;

a return spring for normally urging said piston to move in a direction opposite to said one direction against the hydraulic pressure;

a servovalve disposed between said hydraulic chamber and hydraulic pressure supply and release passages, said servovalve comprising a sleeve operatively coupled to said piston and axially movably disposed in said rotatable shaft, a spool relatively movably disposed in said sleeve and axially movable to provide communication between said hydraulic chamber and said hydraulic pressure supply and release passages, and means for cutting off said communication in response to axial movement of said piston and said sleeve following the axial movement of said spool;

an actuator for actually moving said spool; and a phase adjusting mechanism operatively coupling said piston, said housing, and said rotatable shaft for varying angular relationship between said timing wheel and said rotatable shaft in response to axial movement of said piston.

2. A valve timing control device according to claim 1, wherein said actuator comprises a hydraulic actuator.

3. A valve timing control device according to claim 1, wherein said actuator comprises an electric actuator.

4. A valve timing control device according to claim 1, wherein said phase adjusting mechanism comprises a guide groove defined in said rotatable shaft obliquely to an axis of the rotatable shaft, a guide slot defined in said housing obliquely to the axis of the rotatable shaft, and a roller pin supported on said piston and having opposite ends rollingly fitted in said guide slot.

5. A valve timing control device according to claim 1, wherein said phase adjusting mechanism comprises a guide groove defined in said rotatable shaft obliquely to an axis of the rotatable shaft, a first roller pin supported on said piston and rollingly fitted in said guide groove, a guide slot defined in said housing obliquely to the axis of the rotatable shaft, and a second roller pin supported on said piston and rollingly fitted in said guide slot.

6. A valve timing control device according to claim 1, wherein said phase adjusting mechanism comprises first helical teeth on an outer peripheral surface of said piston, second helical teeth on an inner peripheral surface of said housing in mesh with said first helical teeth, third helical teeth on an inner peripheral surface of said piston, and fourth helical teeth on an outer peripheral surface of said rotatable shaft in mesh with said third helical teeth.

7. A valve timing control device according to claim 1, wherein said housing is rotatably mounted on said rotatable shaft by a bearing, said bearing and said phase adjusting mechanism being disposed near said timing wheel.

8. A valve timing control device according to claim 1, wherein said hydraulic pressure chamber is defined between said housing and said piston.

9. A valve timing control device according to claim 1, wherein said hydraulic pressure release passage is defined axially through said rotatable shaft.

10. A valve timing control device according to claim 1, wherein said actuator includes a driver shaft coupled axially to said spool.

11. A valve timing control device according to claim 10, wherein said driver shaft extends through a cap mounted on said housing in covering relation to an opening thereof remote from said rotatable shaft.

12. A valve timing control device according to claim 10, wherein said driver shaft extends through said hydraulic pressure release passage.

* * * * *